US005805533A

United States Patent [19]

Daigle et al.

[11] Patent Number: 5,805,533

[45] Date of Patent: Sep. 8, 1998

[54] ELECTROLUMINESCENT DISPLAY FOR A TIMEPIECE

[75] Inventors: Lyman R. Daigle, Bethlehem; Walter R. Mack, Watertown; Andrew C. Ledesma, Woodbury, all of Conn.

[73] Assignee: Timex Corporation, Middlebury, Conn.

[21] Appl. No.: 712,727

[22] Filed: Sep. 12, 1996

[51] Int. Cl.[6] ..... G04B 19/32; G04B 19/20

[52] U.S. Cl. ..... 368/226; 368/227; 368/35; 368/37

[58] Field of Search ..... 368/226, 79, 80, 368/82, 84, 28–38

[56] References Cited

U.S. PATENT DOCUMENTS

| | | | |
|---|---|---|---|
| 3,608,300 | 9/1971 | Wingler | 58/5 |
| 3,832,843 | 9/1974 | Wuthrich | 58/57.5 |
| 3,859,783 | 1/1975 | Wuthrich | 58/58 |
| 4,775,964 | 10/1988 | Alessio et al. | 368/67 |
| 5,265,071 | 11/1993 | Thorgersen et al. | 368/67 |
| 5,566,136 | 10/1996 | Schwartz et al. | 368/35 |

FOREIGN PATENT DOCUMENTS

| | | | |
|---|---|---|---|
| 775694 | 1/1968 | Canada | 306/350 |

*Primary Examiner*—Bernard Roskoski
*Attorney, Agent, or Firm*—William C. Crutcher

[57] ABSTRACT

An illuminated date ring for a calendar wristwatch for viewing the date at night through a window in the dial, employs an electroluminescent (EL) lamp beneath a transparent date ring. The EL lamp electrodes extend around the ring, and flexible spring members make sliding contact with the electrodes as the ring rotates in the movement.

7 Claims, 3 Drawing Sheets

ELECTROLUMINESCENT DISPLAY FOR A TIMEPIECE

This invention relates generally to timepieces which are illuminated for night viewing and, more particularly, to a display for a timepiece of the type having a day/date window in the dial for viewing sequentially changing indicia through the window.

BACKGROUND OF THE INVENTION

Timepieces are known which have dials illuminated by electroluminescent (EL) material, originally clocks and more recently wristwatches. A number of constructions have been devised for electrically connecting the EL timepiece dial or an EL lamp behind a transparent timepiece dial to the circuit which drives the electroluminescent lamp. However, when the timepiece dial has a window for viewing indicia carried on a ring beneath the window, as in the case of a calendar or day/date timepiece, it may be difficult to read the indicia through the window. This is especially true when the dial is lighted, since the contrast between the lighted dial and the unlighted area beneath the window makes it very difficult to read the indicia.

Accordingly, one object of the present invention is to provide an improved electroluminescent display for a timepiece having indicia viewed through a window on a timepiece dial.

Still another object of the invention is to provide an improved day/date or calendar display for a timepiece in which the indicia are easily readable through a window in the timepiece dial.

SUMMARY OF THE INVENTION

Briefly stated, the invention is practiced by providing an improved electroluminescent display for a timepiece of the type having a dial with a window opening therein and having a movement adapted to provide a rotational movement to a ring to be rotated beneath the dial window, the improved display comprising a drive circuit for an electroluminescent display, including means for selectively actuating the drive circuit, a ring of transparent insulating material having a sequence of indicia on the upper surface thereof, the ring being disposed beneath the dial for rotation by the movement, an electroluminescent lamp disposed on the underside of the ring beneath the indicia, first and second electrodes connected to the electroluminescent lamp and extending continuously around the ring, and a pair of electrically conductive spring members connected to the drive circuit and arranged to make sliding electrical contact with the first and second electrodes as the ring rotates. Preferably the electroluminescent lamp is a multilayered structure extending continuously around the ring.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

FIG. 1 is a perspective view of a prior art calendar wristwatch movement with an electroluminescent dial, FIG. 2 is a side elevational view in cross section of one side of an analog wristwatch illustrating the invention, FIG. 3 is a plan view of a calendar date ring utilized in the movement of FIG. 2, and FIG. 4 is a side elevational view in cross section, taken along lines IV—IV of FIG. 3, but not drawn to scale.

DESCRIPTION OF THE PREFERRED EMBODIMENT

Figure 1:
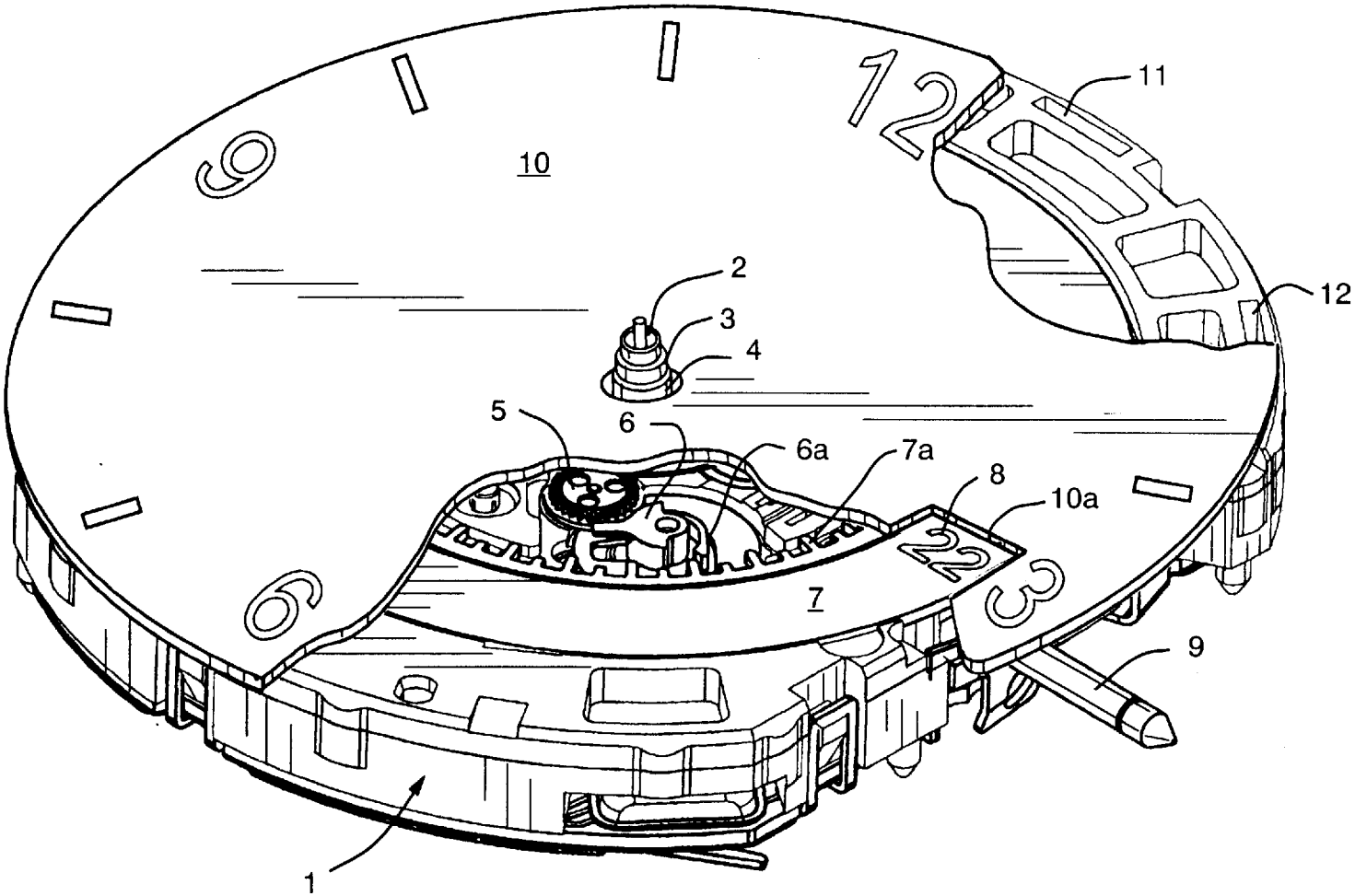
FIG. 1 (PRIOR ART)

Referring now to FIG. 1 of the drawing, the perspective view illustrates a prior art wristwatch movement with an electroluminescent dial. The movement comprises a frame shown generally as 1 containing an internal gear train and electric stepping motor driven by an energy cell. None of these elements are shown since they are not material to the present invention. The stepping motor rotates a "seconds" spindle 2, a "minutes" staff 3, and an "hours" staff 4 carrying the wristwatch hands (not shown). The movement gear train also operates a date pinion 5 turning a date wheel 6 with a pawl 6*a*. A date ring 7 is mounted for rotation within the movement frame 1. Date ring 7 carries a series of sequential indicia 8 indicating the calendar date, and includes radially projecting inner teeth 7*a*. The latter are engaged by pawl 6*a* once every 24 hours so as to provide a periodic rotational movement to ring 7. Ring 7 is held by a spring detent (not shown) each time it advances. A manually rotatable watch stem 9 is also provided to be manually operated by a crown (not shown) to set the hands and to set the date on calendar ring 7, depending upon the type of mechanism used.

A great number of calendar ring mechanisms are known in prior art, the details of which are not material to the present invention. A clock day/date calendar mechanism is illustrated in U.S. Pat. No. 3,608,300 issued Sep. 28, 1971 to W. C. Wingler. A day/date calendar mechanism for a wristwatch is shown in U.S. Pat. No. 3,859,783 issued Jan. 14, 1975 to Paul Wuthrich. A day/date calendar mechanism for a quartz analog wristwatch with an electroluminescent dial is disclosed in U.S. Pat. No. 5,566,130 issued Oct. 15, 1996 having Ser. No. 08/619,288 filed Mar. 18, 1996 in the name of Schwartz et al.

The watch movement of FIG. 1 includes an electroluminescent drive circuit powered by the energy cell, which is used to selectively illuminate an electroluminescent dial 10. Spring contacts 11, 12 extending between terminals on the drive circuit and the underside of dial 10 conduct the electrical impulses necessary to illuminate dial 10.

The type of EL dial 10 is not material to the present invention, but a suitable dial is shown in U.S. Pat. No. 4,775,964 issued Oct. 4, 1988 to Alessio et al. A suitable EL drive circuit is shown in U.S. Pat. No. 4,527,096 issued Jul. 2, 1985 in the name of Kindlmann. A suitable arrangement for connecting the dial 10 to the EL circuit is disclosed in U.S. Pat. No. 5,265,071 issued Nov. 23, 1993 to Thorgersen et al. All of the aforesaid patents are assigned to the Applicant's assignee.

Dial 10 includes a cut-out or window 10*a* above ring 7 for viewing indicia 8. Indicia 8 are hard to read through the window 10*a*, especially when dial 10 is illuminated.

Figure 2:
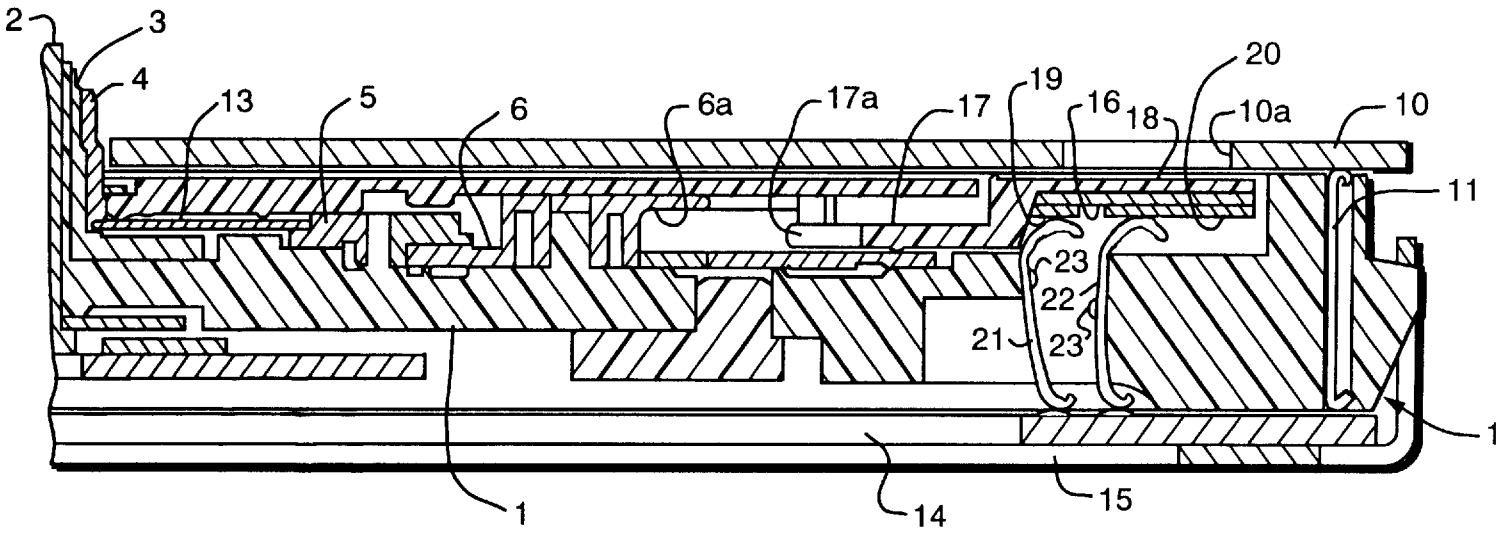
Figure 4:
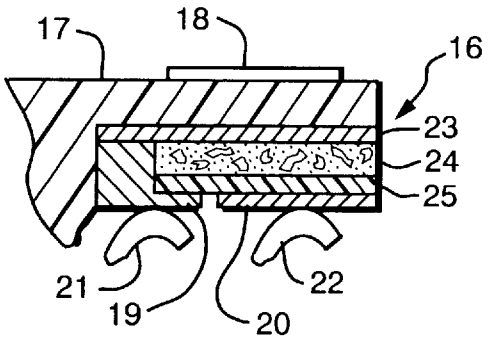
Figure 3:
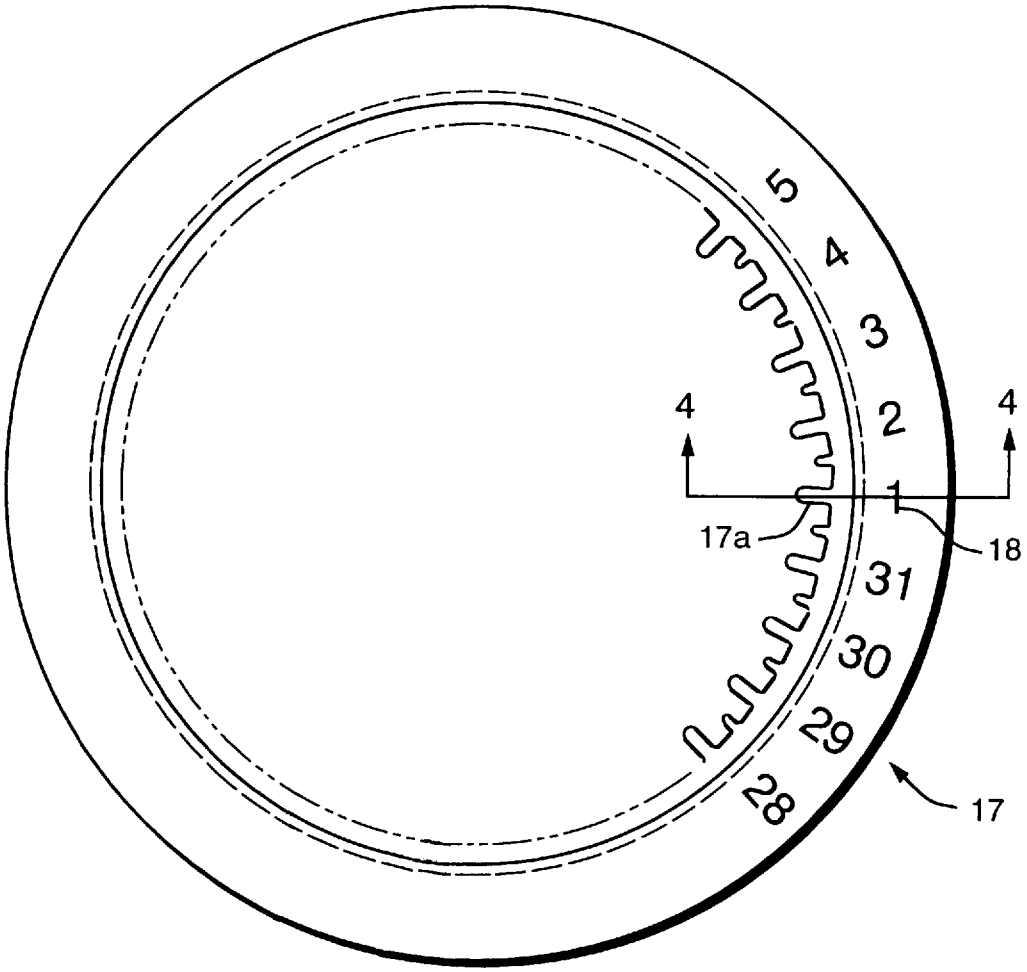

Referring to FIGS. 2 through 4 of the drawing, an improved electroluminescent display according to the invention is illustrated. The invention involves a modification of the date ring and therefore many of the prior art elements are shown which have the same reference numerals as in FIG. 1. Referring to FIG. 2, the cross section shows frame 1 and the rotating "seconds" spindle 2, "minutes" staff 3 and "hours" staff 4. The hours staff 4 is rotated by an hours wheel 13, which is geared to the date pinion 5, the latter turning the date wheel 6 with attached pawl 6*a*. The electroluminescent drive circuit and other electrical components are carried on a printed circuit board 14, which is held in place by a spring clip 15. An electroluminescent dial 10 with window 10*a* is held on the upper side of the movement by supports (not shown). Electrical connections between the electrodes on electroluminescent dial 10 and terminals on PC board 14 are made by a spring clip 11 and a similar spring clip (not shown). Conductive elastomeric connectors may be substituted for the spring clips, as shown in the aforementioned U.S. Pat. No. 5,265,071.

In accordance with the present invention, an electroluminescent lamp 16 is provided on a date ring 17, which is substituted for the date ring 7 of FIG. 1. Date ring 17 is rotatably mounted in frame 1 in the same manner as was the date ring 7, and it carries a sequence of indicia 18 on the upper surface thereof suitably positioned below window 10*a*. Indicia 18 on the ring 17 are arranged to be illuminated by the electroluminescent lamp 16 beneath indicia 18 in the manner of the electroluminescent dial 10 using the same EL drive circuit. On the under side of lamp 16 are a first electrode 19 and a second electrode 20, each of which is a ring extending continuously around the underside of ring 17. Electrodes 19, 20 are connected to lamp 16 and are provided with suitable electrical drive impulses by means of electrically conductive spring members 21, 22 which are arranged to make sliding contact with the first and second electrodes as the ring rotates. The conductive spring members make contact at their lower ends with terminals on PC board 14, and are held in place on frame 1 by suitable means, such as pins 23.

FIG. 3 is a plan view illustrating the construction of ring 17, showing a sequence of indicia 18 on the upper surface thereof and radial teeth 17*a* for turning the ring. The actual cross sectional appearance of the preferred electroluminescent lamp construction is not possible to show to scale in FIG. 2, but may be seen by the cross sectional view of FIG. 4 which is not drawn to scale.

Referring to FIG. 4, ring 17 is constructed of transparent insulating material and indicia 18 are printed on its upper surface. On the undersurface of ring 17 beneath indicia 18 is a transparent conductive layer 23, which is suitably indium tin oxide. A layer of electroluminescent material 24 is disposed on a portion of conductive layer 19, the electroluminescent layer comprising particles of encapsulated electroluminescent phosphor material in a thin layer and held in place in a matrix of cured polymer. Next, a layer of white light-reflecting insulating material 25, such as barium titanate is disposed on layer 20. The first electrode 19 of conductive material such as aluminum is then applied so as to contact conductive layer 23, and the second electrode 20 of conductive material such as aluminum is applied on top of insulating layer 25. Application of EL drive pulses to electrodes 19, 20 thereby serve to cause the electroluminescent layer 24 to luminesce and to illuminate indicia 18 through the transparent ring 17.

While the EL lamp 16 is preferably constructed as a continuous multilayered construction extending around the ring, it could comprise a series of EL lamps connected by the continuous electrodes 19, 20. The electrodes 19, 20 are preferably continuous layers applied in the same manner as the other layers on the ring, but they could also be metal rings attached after the EL lamp is constructed on the ring.

Optionally, the calendar movement may also contain another rotatable day ring with the days of the week. In this case, another window or a larger window is required in the dial and illumination of the day ring may be provided in the same manner as the construction disclosed above.

The invention provides an improved electroluminescent display for a movable member of any type. The invention is especially useful when used for viewing through the window of an electroluminescent dial in a timepiece, either a wristwatch or a clock, but may be used with any type of rotating or movable electroluminescent display.

While there has been described what is considered to be the preferred embodiment of the invention, other modifications will occur to those skilled in the art, and it is desired to secure in the appended claims all such modifications as fall within the true spirit and scope of the invention.

We claim:

1. An improved electroluminescent display for a timepiece having a dial with a window therein and having a movement adapted to provide a rotational movement to a ring adapted to be periodically rotated beneath said dial window, said display comprising:

a drive circuit for an electroluminescent display, including means for selectively actuating the drive circuit, a ring of transparent insulating material having a sequence of indicia on the upper surface thereof, said ring being disposed beneath said dial for rotation by the movement, at least one electroluminescent lamp disposed on the underside of said ring beneath said indicia, first and second electrodes connected to the electroluminescent lamp and extending continuously around the ring, and a pair of electrically conductive members connected to the drive circuit and arranged to make sliding electrical contact with the first and second electrodes as the ring rotates.

2. The combination according to claim 1, wherein the electroluminescent lamp comprises a multilayered structure applied to the underside of said ring, and extending continuously around the ring.

3. The combination according to claim 1, wherein the pair of electrically conductive members are flexible spring members.

4. The combination according to claim 1, wherein the ring is a calendar date ring and the indicia comprise numerals.

5. The combination according to claim 1, wherein the ring is a day ring and wherein the indicia comprise days of the week.

6. An improved electroluminescent display for a timepiece having a dial with a window therein and having a movement adapted to provide a rotational movement to a ring adapted to be periodically rotated beneath said dial window, said display comprising:

a drive circuit for an electroluminescent display, including means for selectively actuating the drive circuit, a ring of transparent insulating material having a sequence of indicia on the upper surface thereof, said ring being disposed beneath said dial for rotation by the movement, a transparent conductive layer on the under surface of said ring, a layer of electroluminescent material disposed on a portion of said conductive layer beneath said indicia, a layer of insulating material disposed on said electroluminescent material, a first electrode in contact with the conductive layer and extending continuously around the ring, a second electrode in contact with the insulating material layer and extending continuously around the ring, and a pair of electrically conductive members connected to the drive circuit and arranged to make sliding electrical contact with the first and second electrodes as the ring rotates.

7. The combination according to claim 1, wherein the first and second electrodes are layers applied to the conductive material layer and the insulating material layer respectively.

* * * * *